US006112670A

United States Patent [19]

Miller et al.

[11] Patent Number: 6,112,670

[45] Date of Patent: Sep. 5, 2000

[54] TIE EJECTION APPARATUS FOR USE WITH A RAILROAD CROSSTIE DISTRIBUTION VEHICLE

[75] Inventors: Robert Miller; Craig Sandsted, both of Columbia; David Hancock, Irmo; Anthony Delucia, Gaston; Roy Moore, Columbia, all of S.C.

[73] Assignee: Harsco Technologies Corporation, Fairmont, Minn.

[21] Appl. No.: 09/072,537

[22] Filed: May 4, 1998

Related U.S. Application Data

[60] Provisional application No. 60/045,529, May 5, 1997.

[51] Int. Cl.[7] ..... E01B 29/06

[52] U.S. Cl. ..... 104/9; 104/6; 104/12

[58] Field of Search ..... 104/2, 6, 9, 11, 104/12

[56] References Cited

U.S. PATENT DOCUMENTS 3,675,580 7/1972 Kershaw ..... 104/9

5,048,424 9/1991 Madison et al. ..... 104/9

5,154,124 10/1992 Madison .

5,186,109 2/1993 Madison .

*Primary Examiner*—S. Joseph Morano

*Assistant Examiner*—Robert J. McCarry, Jr.

*Attorney, Agent, or Firm*—David C. Jenkins; Eckert Seamans Cherin & Mellott, LLC

[57] ABSTRACT

A tie ejector distributes new ties to be installed along a railway track, from a tie distribution car of a rail carried tie exchange vehicle. New ties are moved from a gondola cars to a conveyor at the rear of the tie distribution car leading to the tie ejector. The tie ejector has an endless drive chain on rotatable sprockets on a frame. Two striker plates are attached to the drive chain at opposite ends and opposite sides so that they cannot interfere. One is always on the rear when the other is on the front ejecting a tie by propelling it laterally relative to the conveyor. The trajectory of the tie is adjustable using a movable deflection shield attached to the frame, specifically to adjust the downward deflection angle. The tie ejector can be manually actuated by an operator while the tie distribution car is advanced, to drop ties next to the track at a predetermined and repeatable position relative to passing empty tie cribs.

12 Claims, 6 Drawing Sheets

TIE EJECTION APPARATUS FOR USE WITH A RAILROAD CROSSTIE DISTRIBUTION VEHICLE

CROSS REFERENCES TO RELATED APPLICATION

This application claims priority from U.S. Provisional Application Serial No. 60/045,529, filed on May 5, 1997 and now abandoned.

BACKGROUND OF THE INVENTION

1. Field of the Invention

The invention generally relates to railway track maintenance equipment, and in particular to the manner of distribution of replacement railroad crossties or sleepers along a railway line during refurbishing of the track. A tie ejection apparatus is provided with a conveyor for queuing new ties and an endless drive chain mounted to a frame by a rotatable sprockets. Two striker plates are attached to the drive chain at opposite sides of the mounting frame. New ties are loaded from a storage car and transported by the conveyor to the tie ejection apparatus. The drive chain is rotated, for example under operator control, to bring one of the striker plates into endwise contact with each tie in turn, and to push the tie in one direction or the other from the distribution car to the side of the track. The placement of the tie along the track is repeatably determined by operation of the tie ejection apparatus in conjunction with an adjustable shield attached to the mounting frame, which deflects the tie at a pre-selected angle as it is pushed from the distribution car.

2. Prior Art

Railways comprise a bed of ballast material such as size four stones, in which ties are partly embedded to support rails attached to the ties at a specific gauge width, elevation and the like. The rails rest on tie plates and the rails and tie plates are fastened to the ties by spikes, bolts, clips or similar fasteners. In the United States, most rail ties are made of wood, which helps to absorb shock as trains pass. Concrete ties can also be used. Over time and with traffic, compressive and shearing forces damage the ties and loosen the fasteners. Ties also deteriorate due to weather. As a result, it is necessary to replace the ties as a matter of regular track maintenance.

Typically, ties are selected for replacement and preliminarily marked. The selected ties are disengaged from the rails by removing their fasteners, for example by pulling their spikes, and are pulled laterally from under the rails. A new tie is inserted. Tie plates, spikes and anchors are installed to couple the rail to the tie. The ballast is then rearranged by tamping and vibratory stabilization, often accompanied by realignment and elevational adjustments to the track. A selection of ties can be replaced, or all the ties can be replaced, in which case the tracks are lifted and rethreaded onto the new ties.

Railway ties are usually replaced using a number of special purpose rail cars that service a section of track while traveling over that section. Specialized rail cars may have one or more of spike pullers, tie extractors and inserters, tampers, stabilizers, etc., for serving the successive steps, including transporting new ties to the site and removing the old ties that have been extracted. It is efficient to use the same tie storage cars to bring new ties and to take away worn ties, namely by moving collected old ties to a location in the tie storage car from which new ties were previously unloaded, in a continuous operation. To accomplish this, in addition to having cars with storage space for ties, a track maintenance apparatus can include various transport conveyors, tie removal devices and cranes for manipulating the ties.

An example of a rail based tie exchange system is disclosed in commonly owned PCT Application No. PCT/US97/23156. A tie transfer rail vehicle exchanges old ties for new ties and comprises a plurality of gondola type cars with closed sidewalls and open tops. The tie exchanging operation commences with ties being drawn out from beneath the rails and placed on the rails for pick up by a tie pick-up device which can place the ties on a conveyor leading to an accumulating location. The tie pick-up car alternatively can have a collection cage at the front at track level, to pick up extracted ties left on the rails. A conveyor transports the ties to a temporary collection area from which they can be loaded into a storage car.

The storage cars hold both new ties for distribution and collected old ties, at least some of the space for storage of old ties being made available as the new ties are unloaded and distributed. A number of storage cars can be provided, for example coupled between a tie distribution car at the rear and a tie collection car at the front, in the direction of travel. Tie transport vehicles shuttle back and forth between a point where new ties are being unloaded and where they are distributed, and between a point at which old ties are being stored and where they are collected, respectively. The loading and unloading points vary as work progresses, for example both proceeding in one direction or the other between the front and rear of the apparatus. For allowing the tie transport vehicles (e.g., cranes) to pass between cars, the vehicles have flanged wheels and the storage cars have rails along their tops, including telescoping hinged sections which bridge between cars. One or more transport vehicles moves the old ties from the temporary tie collection area to the storage cars and loads and moves new ties from the storage cars to the tie distribution car where they are distributed alongside the rails for installation by a following apparatus.

Although this rail based tie exchange system accomplishes tie removal and distribution in an integrated manner, it distributes new ties using a ramped conveyor, which together with the periodic arrival of the transfer vehicle may discharge the ties intermittently. Assuming that sufficient ties are queued for discharge, they are discharged regularly, which may be useful for replacing all the ties on a track but is not useful for replacing irregular selected ties. Without good control of the position at which ties are discharged, before the ties can be placed under the rails it is often necessary to pick them up and move them. This extra step slows the replacement process. It would be helpful if each tie could be placed at the position where the tie is to be inserted. It would be even more helpful to precisely position and also orient the ties in a precise and repeatable manner.

An alternative to using a conveyor to distribute ties is disclosed in U.S. Pat. No. 5,467,717 -Theurer where a crane is used to pick up and place each tie individually. This permits the ties to be placed where they are to be installed and minimizes the need for an additional positioning step, but is very slow. A more efficient tie ejecting device is needed, which nevertheless allows controllable tie positioning and discharge at the point of installation.

SUMMARY OF THE INVENTION

It is an object of the invention to efficiently transport, store and distribute railroad ties.

It is a further object to optimally integrate tie removal and the distribution of new ties.

It also an object to quickly and precisely place ties along a railway at the points where they are needed, and repeatably to position and orient them relative to such points.

These and other objects are accomplished by a tie ejection apparatus mounted on a rail carried tie exchange vehicle. The tie ejection apparatus has an endless drive chain mounted to a frame by rotatably driven spaced sprockets such that the drive chain is bi-directionally movable along the periphery of the frame. A motor is coupled to one of the sprockets for selectively activating the drive chain. First and second striker plates are mounted to the drive chain and are spaced from one another by a distance greater than the distance between the sprockets. As a result, the striker plates are always on opposite sides of the frame and it is not possible for a striker plate to interfere with a tie being moved by the other. Preferably, the striker plates are placed to reside on opposite ends and on opposite sides of the frame and move around the ends.

Each striker plate can be responsible for pushing a tie in a specified direction, i.e. to the right or left, off of the tie distribution car, depending upon the direction in which the drive chain is rotated. Alternatively, the striker plates can be used alternately to discharge ties in the same direction by continuing to rotate the chain in the same direction.

A set of adjustable shields are mounted to opposite sides of the top of the frame. Each shield extends downwardly from the frame into the path of ties ejected on the respective side, and acts as a bumper for deflecting the tie as it is ejected. The shields repeatably control the position of the ties along the rails by controlling the trajectory of each tie's flight from the apparatus.

The rail based tie exchange vehicle can include a plurality of storage cars which transport and store new ties for distribution, having guide rails along their tops, and telescoping hinged sections which bridge between successive cars to allow tie transport and loader vehicles to travel along the length of the storage cars. The loader vehicles move the ties from their storage location to a tie distribution car at the rear of the tie exchange rail vehicle where a conveyor transports the ties to the end of the tie distribution car and to the tie ejection apparatus is mounted. The ties are queued up, preferably oriented perpendicular to the rails. The conveyor carries the endmost tie into abutting contact with the mounting frame of the tie ejector. When the drive chain of the ejector is rotated, one of the striker plates contacts the end of the tie and pushes it off of the distribution car and onto the side of the track.

Other objects, advantages and features of the invention will become apparent from the following detailed description of the invention when considered in conjunction with the accompanying drawings.

BRIEF DESCRIPTION OF THE DRAWINGS

There are shown in the drawings embodiments of the invention as presently preferred. It should be understood, however, that the invention is not limited to precise arrangements and instrumentalities shown as examples.

DETAILED DESCRIPTION OF THE PREFERRED EMBODIMENTS

Figure 1:
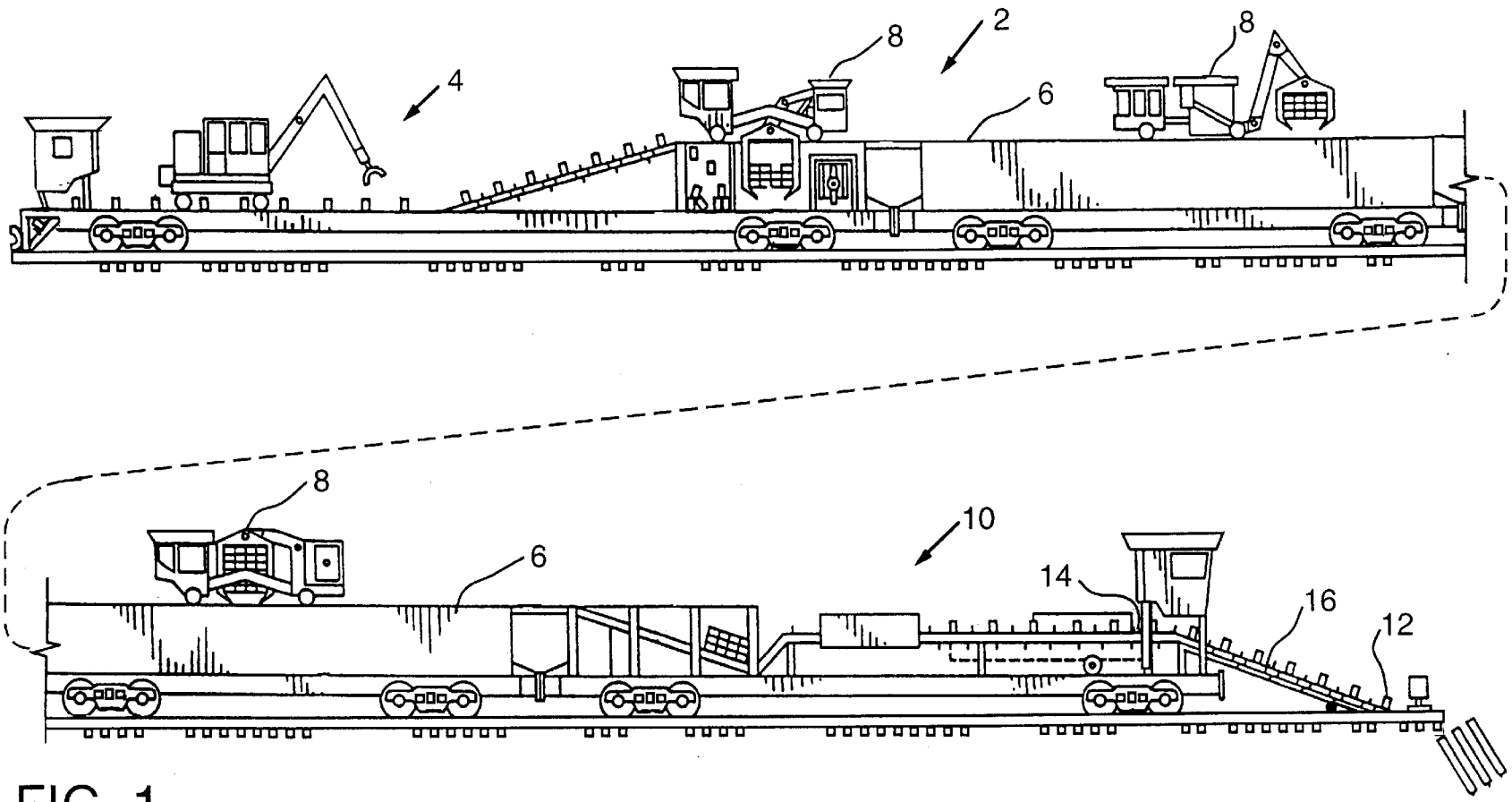
FIG. 1 is a side elevational view of a tie exchanging vehicle.

In the drawings, the same reference numbers are used throughout to identify corresponding elements. FIG. 1 shows an example of a rail based tie exchange vehicle 2 for the removal of worn ties and the distribution of new ties. The vehicle 2 comprises a tie pick-up car 4 at the front for collecting used ties, in this case using a boom crane. A plurality of storage or gondola cars 6 initially contain new ties for distribution and as work proceeds are used to collect and transport used ties. Finally, a new tie distribution car 10 is located at the rear. Tie pick-up car 4, storage cars 6, and new tie distribution car 10 as shown are supported on standard rail undercarriages. In the alternative, one or more of cars 4, 6, and 10 could be road vehicles which are adapted for rail travel by railway guide wheel devices, such as the type disclosed in U.S. Pat. Nos. 5,186,109 and 5,154,124.

Cars 6 store new ties 12 for distribution along the rails 3. The new tie distribution car 10 is located at the rear of the tie exchange vehicle 2, attached to cars 6. The tie distribution car 10 shown in FIG. 1 accepts new ties 12 from cartop transport 8 and a conveyor 14 spaces and carries the ties rearward to ramped conveyor 16 at the rear of the tie distribution car. Ramped conveyor 16 is mounted to tie distribution car 10 at its proximal end and is supported at its distal end by rail wheels 21. The ramped conveyor unloads the new ties 12 onto the ground, and they subsequently are placed beneath and attached to rails 3 by a following tie replacement apparatus (not shown).

Figure 2:
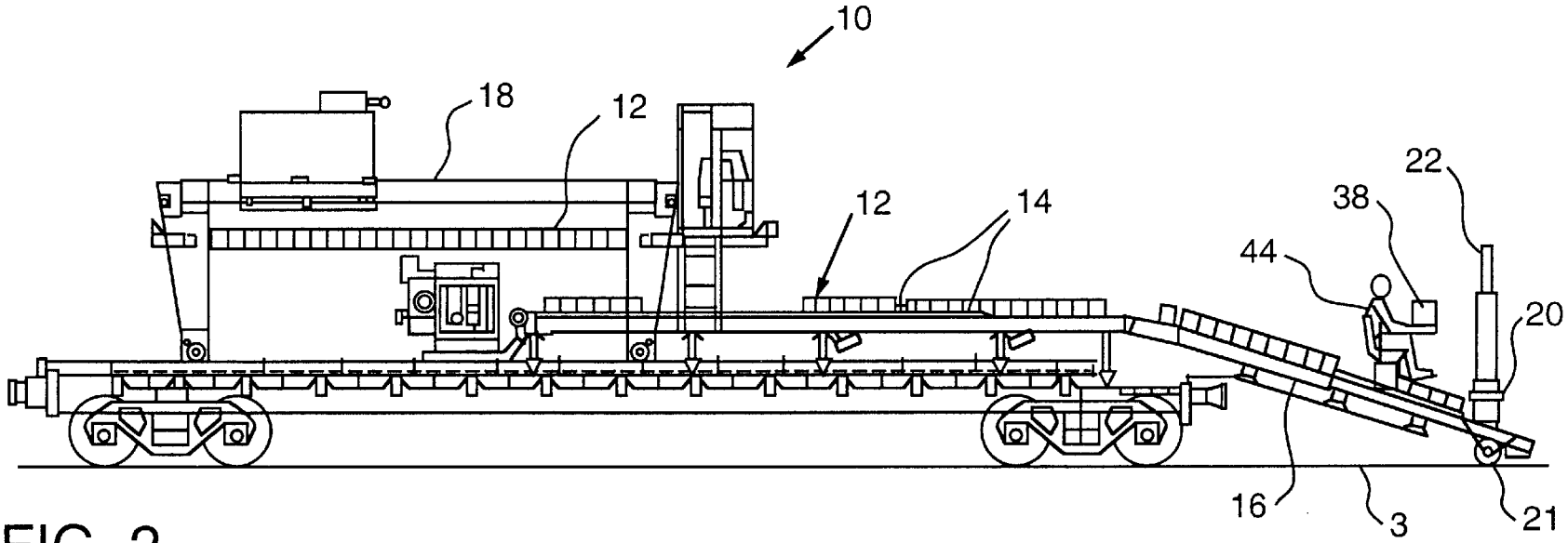
FIG. 2 is a side elevational view of a new tie distribution car of a tie exchanging vehicle.
Figure 2A:
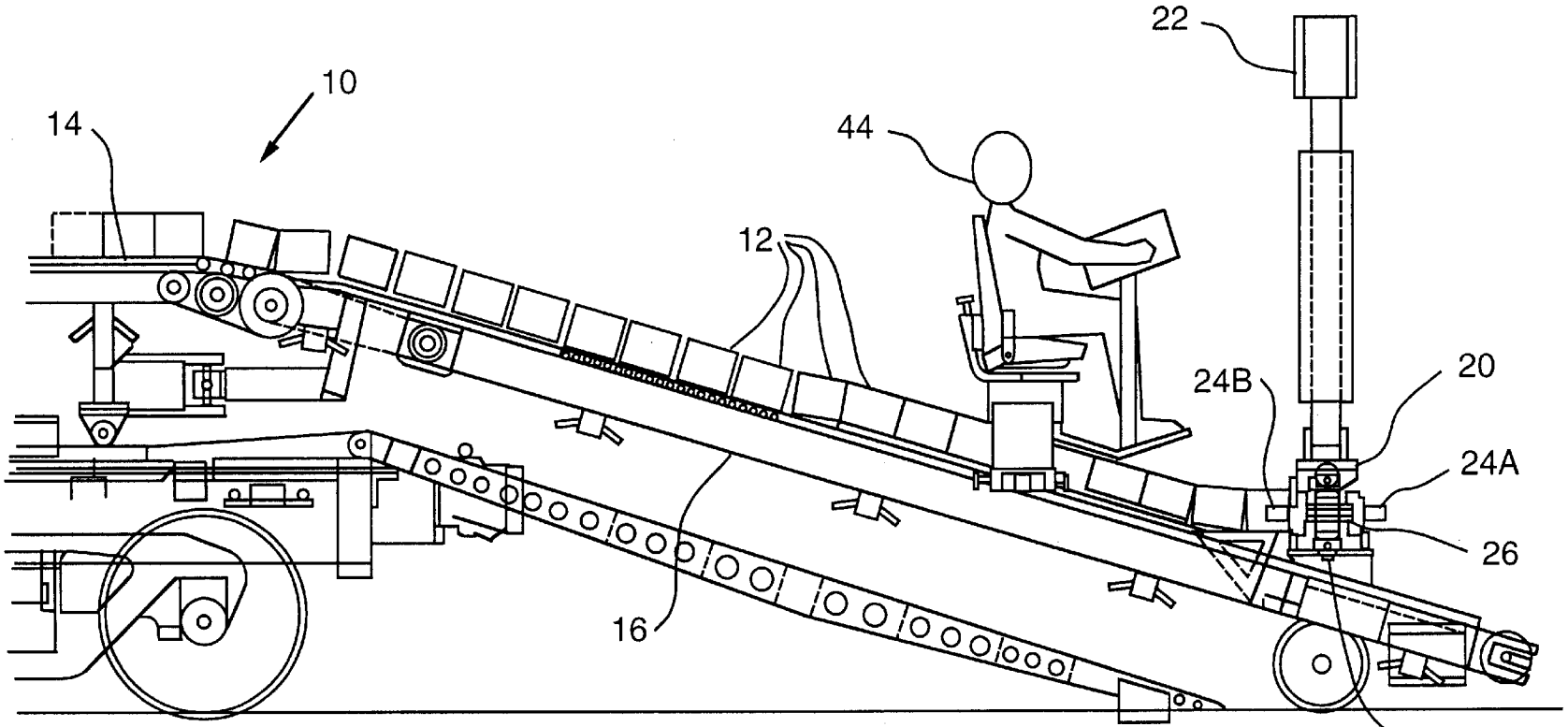
FIG. 2A is a side elevational view of the rear portion of the tie distribution car shown in FIG. 2.

As shown in FIG. 1, tie transport and loading vehicles 6 travel along guide rails atop cars 4, 6 and 10. These cars pick up loads of new ties from storage cars 4 and transport them to conveyor 14 on new tie distribution car 10. An alternative type of tie transport apparatus is shown in FIG. 2, namely a gantry crane 18. The gantry crane repetitively engages a row of ties from a tie storage car (not shown in FIG. 2) and carries them to the conveyor 14 on tie distribution car 10, where they are set down, and returns for more.

If a ramped conveyor 16 is used alone to discharge ties 12 onto rails 3, the ties may be discharged in an intermittent and sporadic manner, and the point at which a given tie is discharged frequently will not correspond to the location of an empty tie crib installation of a new tie. The tie ejection apparatus 20 of the invention enables the precise placement of ties 12 along the trackside, and can operate as fast or faster than a ramped conveyor the feeds ties at regular spacing. Tie ejection apparatus 20, as shown in FIG. 2, is mounted to the end of a ramped conveyor 16, which is used to queue ties for discharge, oriented laterally relative to the track. The tie ejection apparatus 20 engages the end of the endmost tie 12 and pushes or ejects it laterally off ramp 16. The operator 44, who sits adjacent to the point of discharge monitors for empty tie cribs as the apparatus advances and activates the ejector mechanism to cast a tie laterally to the side of the track at each empty crib. The ramp conveyor 16 operates continuously until a tie contacts apparatus 20, whereupon conveyor 16 is switched off. After the tie 12 is ejected under operator control, conveyor 16 is reactivated to bring another tie into position for ejection, in contact with the tie ejection apparatus 22, which forms an end stop for ramp conveyor 16.

Figure 3:
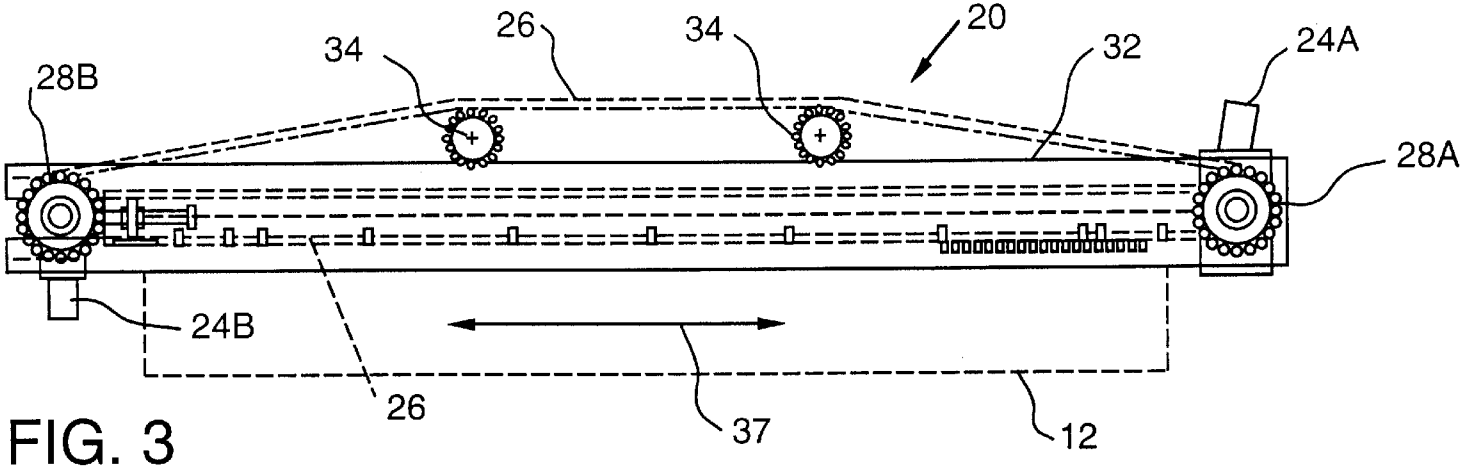
FIG. 3 is an overhead view of the tie ejection apparatus of the invention.
Figure 5:
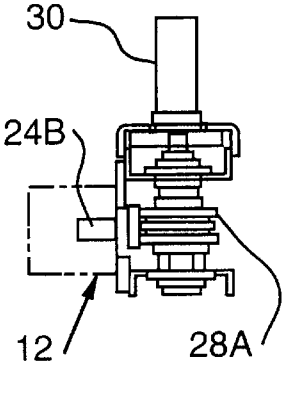
FIG. 5 is a side elevational view of the tie ejection apparatus.
Figure 4:
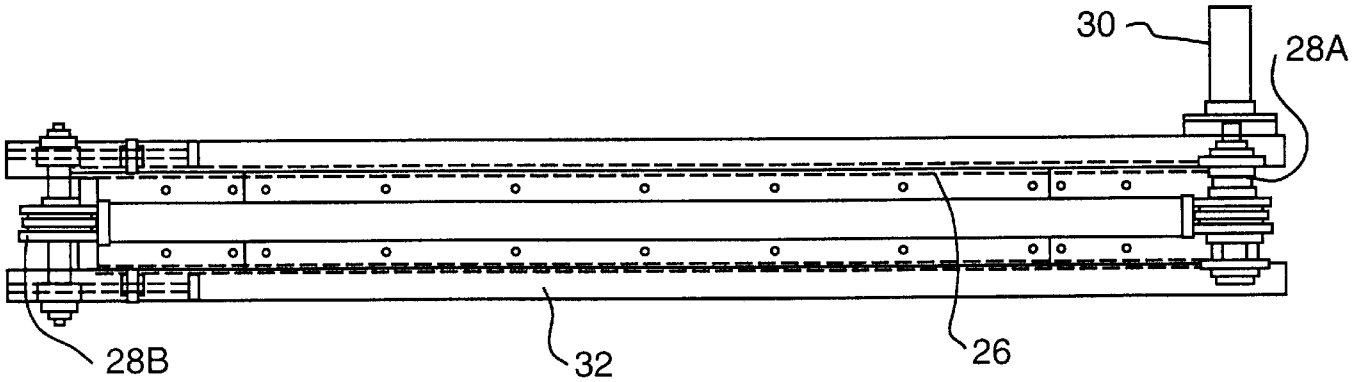
FIG. 4 is a rear elevational view of the tie ejection apparatus.

The tie ejection apparatus 46 is shown in more detail in FIGS. 3 through 5. The tie ejection apparatus 20 comprises an endless loop drive chain 26 carried on a plurality of rotatable sprockets 28A, 28B, 34A and 34B mounted on a frame 32. Drive chain 26 rotates about the periphery of frame 32, passing around the endmost pair of sprockets 28A and 28B at opposite ends of frame 32. One or both of sprockets 24A and 24B is coupled to a preferably- reversible drive motor 30 which rotates drive chain 26 under operator control. It is also possible, for example when replacing all the ties on a track, to power the chain for continuous operation or continuous alternating operation, discharging ties regularly by time or by distance travelled, and toward one or both sides of the track. Sprockets 34A and 34B are mounted to the back side of frame 32 and are adjustable inwardly and outwardly to control the tension of chain 26.

At least a first striker plate 24A, and preferably a second striker plate 24B, are mounted to the drive chain 26. Striker plates 24A and 24B are spaced on chain 26 by a distance greater than the distance between sprockets 28A, 28B, and preferably are placed at opposite ends and opposite sides of the frame 32. In this manner, when one of the strikers is deployed against the end of a tie, the other striker is necessarily out of the way on the opposite side of the endless loop. If a single striker plate is used, then it can be placed anywhere along the chain.

The striker plates 24A and 24B can be used to push tie 12 in a specified direction, i.e. one striker pushing to the right and the other to the left, as indicated by arrow 37, depending upon the direction in which the drive chain 26 is rotated. In that case, or if a striker is to be deployed and then retracted, the drive motor or gearing reverse the direction which the drive train rotates. Alternatively, the drive can be operated continuously in a single direction such that as one striker plate discharges a tie, the other striker plate is brought around into position to discharge the next tie in the same direction. If only one striker plate is utilized, the drive rotates the striker plate around the mounting frame in the desired direction until the striker plate contacts the tie and ejects it. Ties are repeatedly ejected by continuously rotating the single striker plate around the mounting frame.

When two striker plates are utilized, then during operation of ejector 20, one of the striker plates, i.e. 24A in FIG. 3, is on the back side relative to the tie and at the discharging end of the frame 32 while the other striker plate, i.e. 24B in FIG. 3, is on the tie side opposite to the discharging end, in place to contact and discharge the tie. This orientation ensures that the striker plate, either 24A or 24B, which is not ejecting the tie 12 in placed in a non-obstructing position on the rear face of the frame 32. For example, if it is desired to eject a tie 12 to the right side of the car, chain 26 is rotated counterclockwise in FIG. 3, placing striker plate 24B against the tie and striker plate 24A out of the way behind the frame 32. As chain 26 is rotated, striker plate 24B pushes the tie off to the right. At the end of the stroke, striker plate 24B moves into the position occupied by striker plate 24A in FIG. 3, and striker plate 24A is moved into position to eject the next tie. Alternatively, the chain can be reversed such that the next tie is ejected in the opposite direction.

Figure 6:
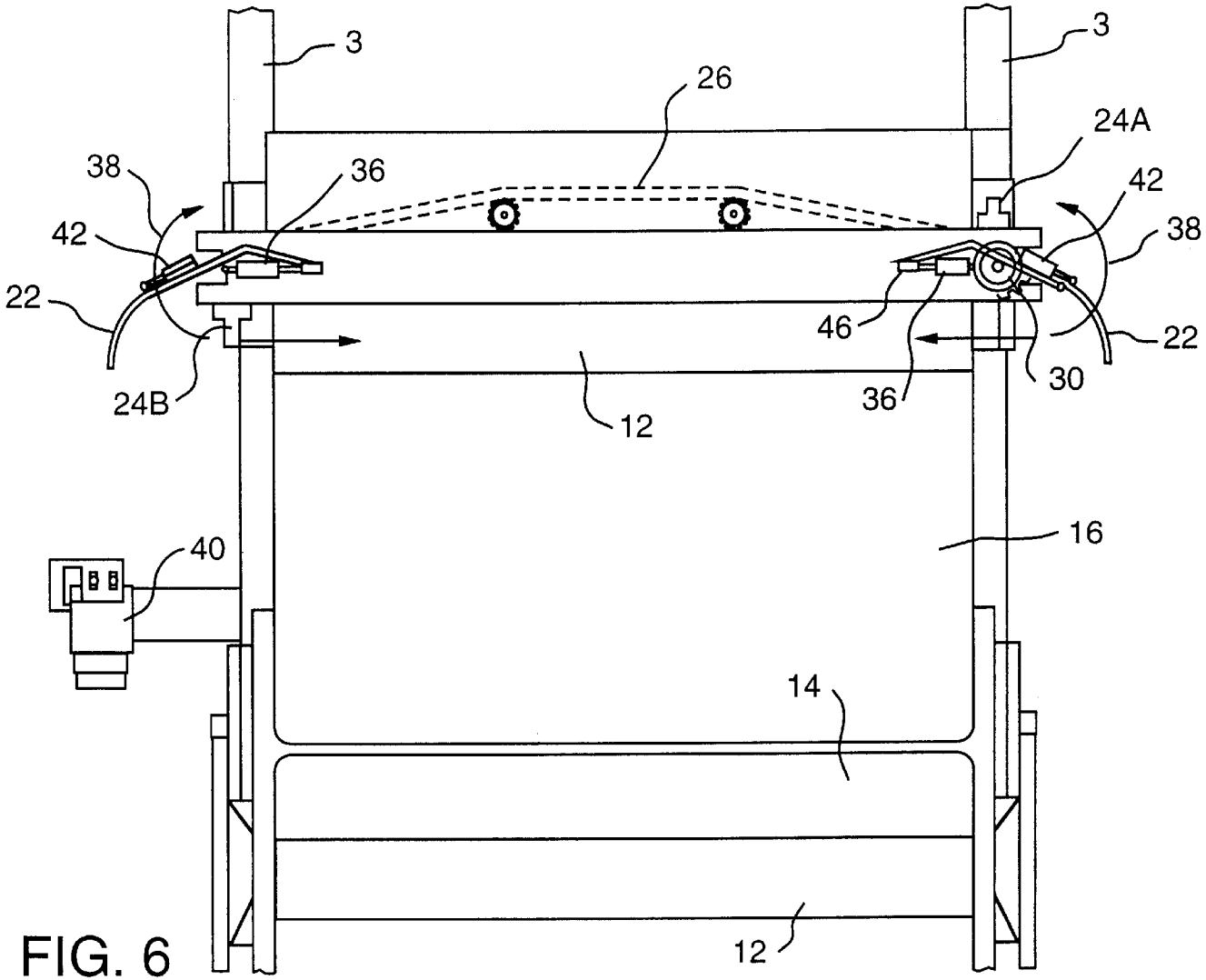
FIG. 6 is an overhead view showing the tie ejection apparatus mounted to a tie distribution car of a tie exchanging vehicle.
Figure 8:
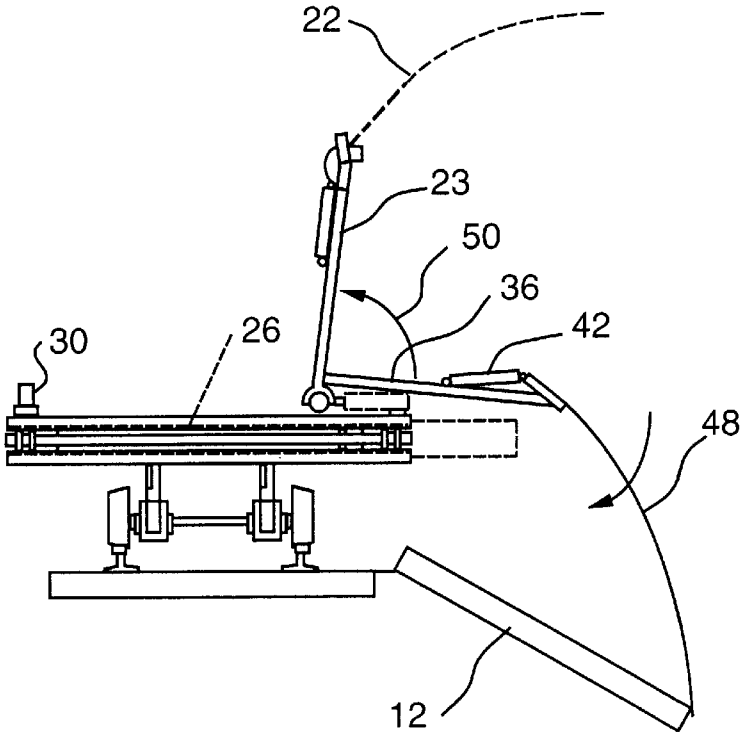
FIG. 8 is a rear elevational view of the tie ejection apparatus.
Figure 7:
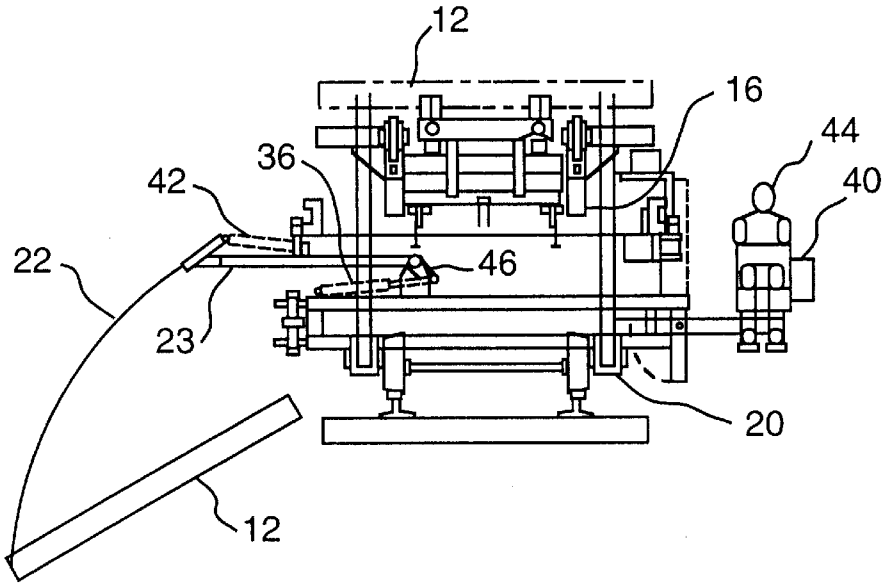
FIG. 7 is a rear elevational view showing the tie ejection apparatus mounted to a tie distribution car of a tie exchanging vehicle.

FIGS. 6–8 show a set of adjustable shields 22 mounted to opposite sides of the top of the frame 32 for controlling the trajectory of ejected ties and therefore permitting control of their final position alongside the track. Each shield 22 comprises a preferably resilient curved strap or bar extending downwardly from the frame into the path of the tie. Shield 22 acts as a bumper for deflecting tie 12 as it is ejected. By lowering the shield, the tie is deflected more downwardly and ends up closer to the rail, or by raising the shield the tie is deflected less and allowed to travel farther from rails 3. The shields are useful on a sloping bed of ballast or on a hillside where full power ejection could otherwise propel the tie too far from the rail to be reached by a subsequent tie insertion device (not shown).

The angle at which the ties 12 are deflected by shields 22 is adjustable by changing the relative angle 48 between shield 22 and the frame 32. The shields 22 are connected to frame 32 by an arm 23. Each shield is pivotally mounted to arm 23 and a hydraulic piston 42 is interconnected between arm 23 and shield 22 such that actuation of the hydraulic cylinder 42 moves the shield by the desired amount downward or upward.

While the rail exchange vehicle 2 is traveling along rails 3, it is may be necessary to retract the shields 22 to prevent contact with an obstruction. Arm 23 is mounted to the frame 32 by a rocker linkage 46. A hydraulic piston 36 operates in conjunction with the rocker arm linkage 46 to pull the shield 22 upwards in a direction indicated by arrow 50, as shown in FIG. 8.

The operation of the tie ejection apparatus can be summarized with reference to FIGS. 1, 2 and 6. A loader vehicle 8 or a gantry crane 18 moves ties 12 from the storage cars and unloads them on tie distribution car 10 at the end of tie exchange rail vehicle 2, specifically on the rearward leading conveyor 14. Conveyor 14 and following ramp conveyor 16 queue up the ties and transport them rearwardly to tie ejection apparatus 22. The conveyor 16 brings each tie 12 to mounting frame 32, which provides the lateral ejection mechanism described above. An operator seated at panel 40 controls operation of the tie ejection apparatus 22, ejecting a tie at each position along the track where one is needed, either by watching for empty cribs or in the case of a full replacement at regular intervals of time or distance. The operator also controls deployment and retraction of deflector shields 22 by operation of hydraulic cylinders 42, and adjusts for the proper angle of deflection by operation of hydraulic cylinder 36. As ties are ejected from ramp 16 further adjustment of the shields 22 can be effected until the proper placement of the ties 12 along the side of rails 3 is obtained in a repeatable manner.

Preferably, the operator controls permit selection of the side of ramp 16 from which ties 12 will be ejected. The ties can be ejected repetitively to the same side, on alternating sides or in any combination. The operator activates drive motor 30 to rotate drive chain 26 at the required time and in the desired direction to eject the ties. A following vehicle attends to installing tie 12 in the empty tie crib underneath the rails.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. A tie ejection apparatus for use in the distribution of ties along a railway comprising:

an elongated mounting frame having a front face and a rear face;

at least two sprockets rotatably mounted on the elongated frame;

a drive chain carried on said rotatable sprockets;

at least one striker plate mounted to the drive chain; structured to cast ties laterally to the side of the railway; and means coupled to at least on of the sprockets for rotating the drive chain.

2. The tie ejection apparatus of claim 1, further comprising a tie transport conveyor for feeding ties to the ejection apparatus, the tie transport conveyor being operable to bring a long side of a rectangular tie into abutting contact with the front face of the mounting frame.

3. The tie ejection apparatus of claim 2, wherein rotation of the drive means brings said at least one striker plate around the mounting frame so as to contact a short side of an elongated railway tie and propel the laterally of the conveyor.

4. The tie ejection apparatus of claim 1, wherein the drive means comprises a reversible hydraulic motor.

5. A tie ejection apparatus for use in the distribution of ties along a railway comprising:

an elongated mounting frame having a front face and a rear face;

a drive chain mounted to the elongated frame by at least of two sprockets so as to be rotatable relative to the elongated frame;

at least one striker plate mounted to the drive;

means coupled to at least one of the sprockets for rotating the drive chain;

a tie transport conveyor for feeding ties to the ejection apparatus, the tie conveyor being operable to bring a long side of a rectangular tie into abutting contact with the front face of the mounting frame;

wherein the rotation of the drive means brings said at least one striker plate around the mounting frame so as to contact a short side of an elongated railway tie and propel the tie laterally off the conveyor; and a tie deflection shield protruding into a path of the tie, for altering a trajectory of the tie.

6. A tie ejection apparatus for use in the distribution of ties along a railway comprising:

an elongated mounting frame having a front face and a rear face;

a drive chain mounted to the elongated frame by at least of two sprockets so as to be rotatable relative to the elongated frame;

at least one striker plate mounted to the drive;

means coupled to at least one of the sprockets for rotating the drive chain;

a tie transport conveyor for feeding ties to the ejection apparatus, the tie conveyor being operable to bring a long side of a rectangular tie into abutting contact with the front face of the mounting frame;

wherein the rotation of the drive means brings said at least one striker plate around the mounting frame so as to contact a short side of an elongated railway tie and propel the tie laterally off the conveyor; and a deflection shield mounted by an arm to the mounting frame, the tie deflection shield being hinged to the arm, and further comprising a hydraulic cylinder interconnected between the arm and the shield, whereby the cylinder is actuated to move the shield relative to the arm for setting a deflection angle.

7. The tie ejection apparatus of claim 6, wherein two said deflection shields are mounted at opposite ends of the frame for ejecting and deflecting ties in opposite directions.

8. The tie ejection apparatus of claim 6, wherein the arm is hinged to the mounting frame and further comprising a hydraulic cylinder connected between the arm and the frame for retracting the deflection shield.

9. A method of distributing new ties using a rail carried tie exchange vehicle having a tie storage car and a tie distribution car comprising the steps of:

conveying ties to a rear of the tie distribution car;

providing a laterally operable endless chain pushing apparatus at the rear of the distribution car, having at least one striker plate mounted thereto;

placing a tie in abutting contact with the mounting frame; and, rotating the drive chain, causing the at least one striker plate to contact and propel the tie from the tie distribution car while the other of the striker plates is kept clear.

10. The method of claim 9, further comprising deflecting the tie by placing a downwardly extending deflector shield in a trajectory of the tie.

11. The method of claim 10, further comprising adjusting an angle of the deflector shield for controlling a distance at which the tie is left from the rail.

12. The method of claim 9, further comprising monitoring the rail for empty cribs and operating the pushing apparatus as the tie passes over an empty crib.

* * * * *

UNITED STATES PATENT AND TRADEMARK OFFICE

CERTIFICATE OF CORRECTION

PATENT NO. : 6,112,670
APPLICATION NO. : 09/072537
DATED : September 5, 2000
INVENTOR(S) : Robert Miller et al.

It is certified that error appears in the above-identified patent and that said Letters Patent is hereby corrected as shown below:

Column 1, line 5, change the word “REFERENCES” to --REFERENCE--.

Column 7, line 15, after the word “structured” add --for engaging ties--.

Column 7, line 17, change “on” to --one--.

Signed and Sealed this

Twenty-fifth Day of December, 2007

JON W. DUDAS
*Director of the United States Patent and Trademark Office*